US005280739A

United States Patent [19]

Liou

[11] Patent Number: 5,280,739

[45] Date of Patent: Jan. 25, 1994

[54] HANDLE OF A HAMMER HAVING A SHOCK ABSORBING CONFIGURATION

[76] Inventor: Mou T. Liou, No. 33, Hsi Hu Rd., Ta Li Hsiang, Taichung Hsien, Taiwan

[21] Appl. No.: 984,848

[22] Filed: Dec. 3, 1992

[51] Int. Cl.[5] ..... B25G 1/00

[52] U.S. Cl. ..... 81/22

[58] Field of Search ..... 81/20, 22

[56] References Cited

U.S. PATENT DOCUMENTS 4,331,193 5/1982 Tudisco ..... 81/22
4,548,248 10/1985 Riemann ..... 81/22
4,683,784 8/1987 Lamont ..... 81/22
4,738,166 4/1988 Yamaguchi ..... 81/22

*Primary Examiner*—James G. Smith
*Attorney, Agent, or Firm*—Hedman, Gibson & Costigan

[57] ABSTRACT

A hammer includes a shaft having a beam and two bars and a hand grip having an opening and two holes for engagement with the beam and the bars, each of the holes includes a length longer than that of the bar such that a space is formed in each of the holes when the bar is engaged in the hole. The spaces form a shock absorbing configuration of the handle of the hammer.

1 Claim, 2 Drawing Sheets

HANDLE OF A HAMMER HAVING A SHOCK ABSORBING CONFIGURATION

BACKGROUND OF THE INVENTION

1. Field of the Invention

The present invention relates to a hammer, and more particularly to a handle of a hammer having a shock absorbing configuration.

2. Description of the Prior Art

A typical hammer is disclosed in FIG. 4 and includes a rod 91 extended from the body 90 of the hammer and a hand grip 92 engaged on the rod 91 and preferably made of rubber materials or foamable materials so as to provide a comfortable hand grip characteristics. However, generally, the hand grip 92 includes a solid structure which may not absorb shocks excellently.

The present invention has arisen to mitigate and/or obviate the afore-described disadvantages of the conventional handles of the hammers.

SUMMARY OF THE INVENTION

The primary objective of the present invention is to provide a handle of a hammer which includes a shock absorbing configuration for absorbing vibrations and shocks transmitted to the hands of the users.

In accordance with one aspect of the invention, there is provided a hammer comprising a shaft including a beam and at least one bar extended therefrom, and a hand grip including an opening and at least one hole formed therein for engagement with the beam and the bar respectively such that the hand grip is coupled to the shaft. The hole includes a length longer than that of the bar such that a space is formed in the hole when the bar is engaged in the hole. The hand grip includes two opposite parallel portions each having a longitudinal recess formed therein.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
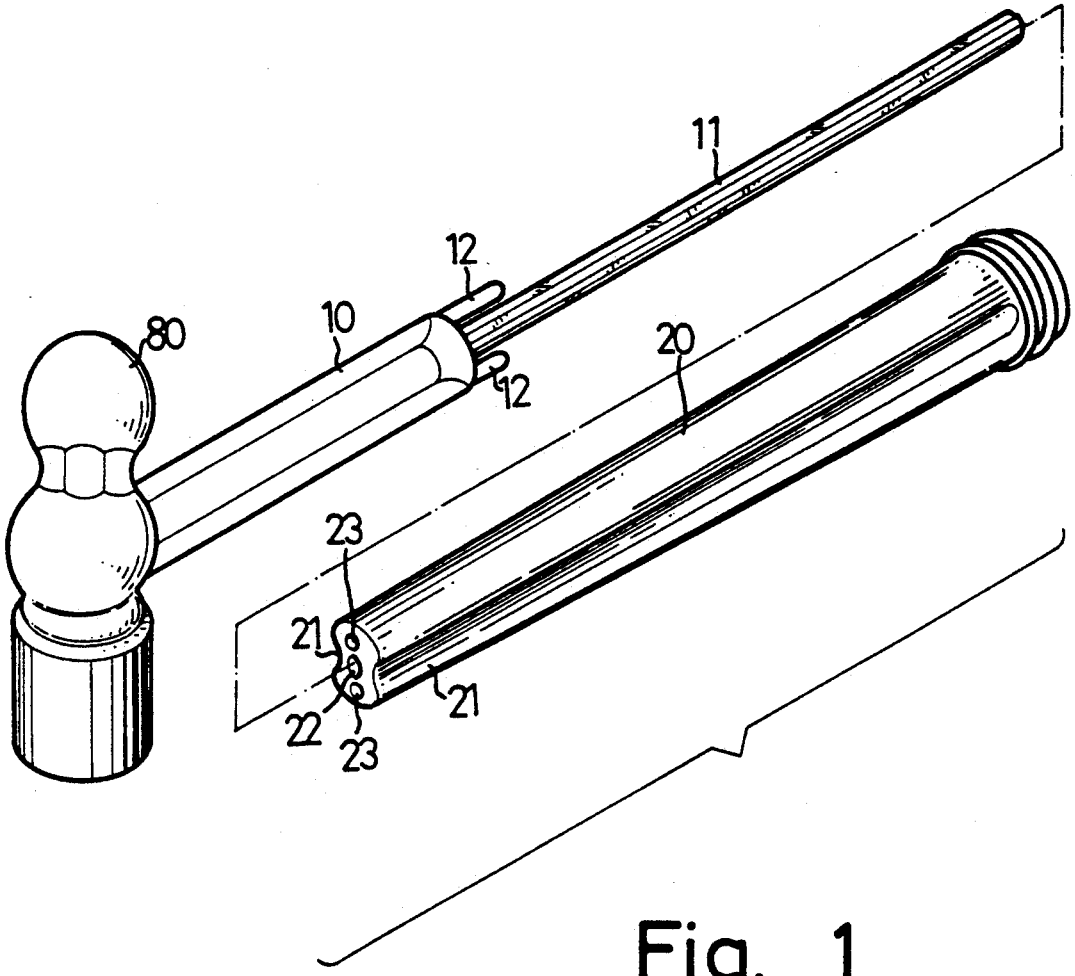
FIG. 1 is an exploded view of a hammer in accordance with the present invention.
Figure 3:
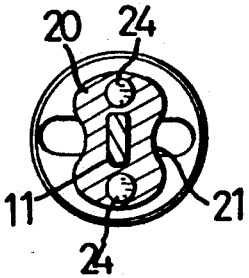
FIG. 3 is a cross sectional view taken along lines 3—3 of FIG. 2.
Figure 2:
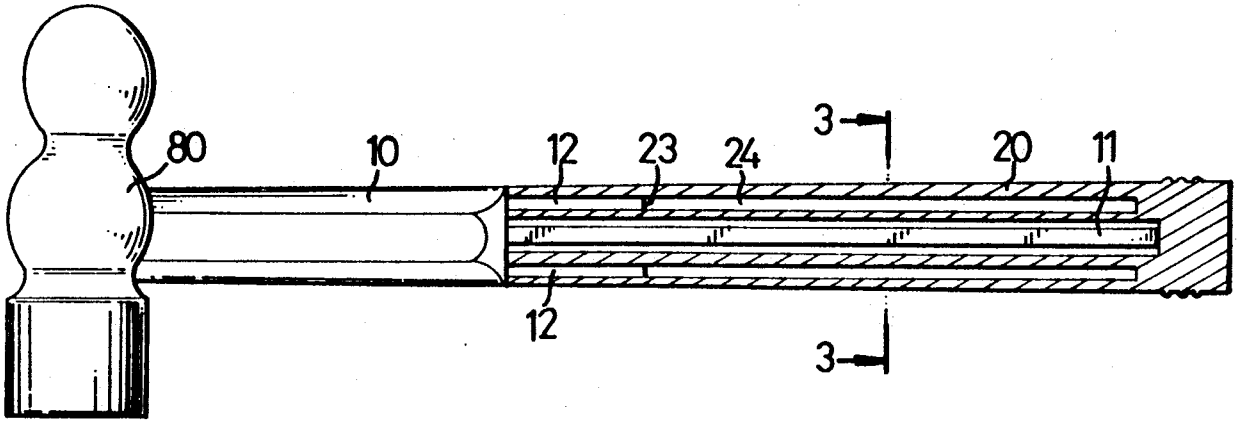
FIG. 2 is a cross sectional view of the hammer.
Figure 4:
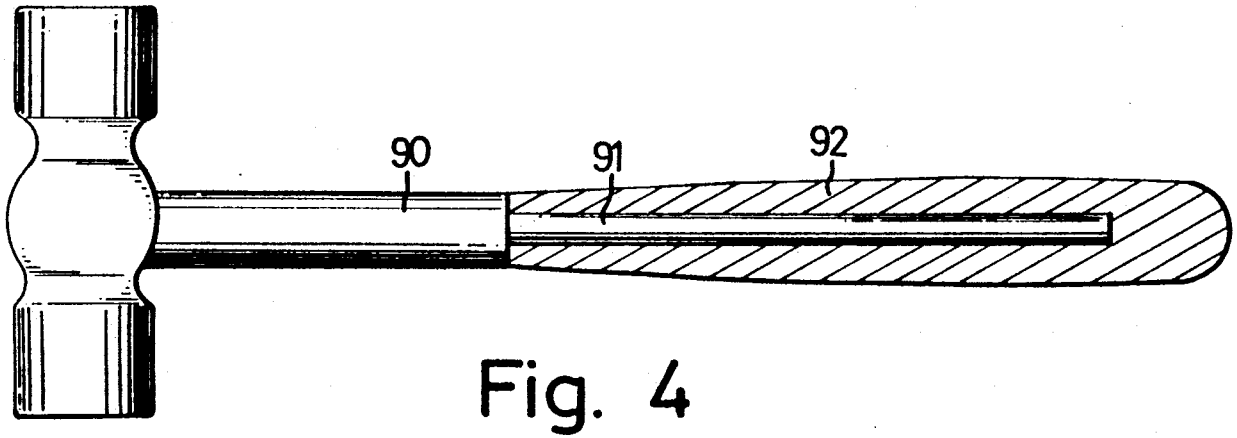
Fig. 4 PRIOR ART
FIG. 4 is a cross sectional view illustrating the handle portion of the typical hammer.

Referring to FIGS. 1, 2 and 3, a hammer in accordance with the present invention comprises a shaft 10 including a head 80 fixed on one end and a beam 11 and a pair of bars 12 extended from the other end and preferably arranged in parallel with one another, and a hand grip 20 including an opening 22 and a pair of holes 23 formed in one end thereof for engagement with the beam 11 and the bars 12 of the shaft 10 so that the hand grip 20 can be coupled to the shaft 10 of the hammer. The beam 11 is preferably arranged between the bars 12. The hand grip 20 is also preferably made of soft materials, such as rubber, foamable materials, etc., and includes a pair of longitudinal recesses 21 oppositely formed in the laterally portion thereof and arranged such that the cross section of the hand grip 20 has a shape close to the numeral "8", the shape is not circular and is excellent for hand grip purposes, the users may grip the hammer solidly and comfortably.

It is preferable that the beam 11 includes a cross section having any kind of shapes, however, as best shown in FIG. 3, it is preferable that the cross section of the beam 11 includes a height greater than the width thereof. The beam 11 preferably has a length equals to that of the opening 22 such that the beam 11 is completely engaged in the opening 22; however, the holes 23 have a length longer than that of the bars 12 such that a longitudinal space 24 (FIGS. 2 and 3) is formed in each of the holes 23 after the bars 12 are engaged in the holes 23 respectively. The longitudinal spaces 24 provide the hand grip 20 a compressible and deformable characteristics such that the vibrations and shocks transmitted to the hand grip 20 can be absorbed. The users may further feel comfortable when gripping the hand grip 20 of the hammer.

Accordingly, the handle of the hammer in accordance with the present invention includes a shock absorbing configuration that may absorb the vibrations and shocks transmitted to the hand grip 20.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A hammer comprising a shaft including a beam and a pair of bars extended therefrom, said beam being arranged between said bars, and a hand grip including an opening and a pair of holes longitudinally formed therein for engagement with said beam and said bars respectively such that said hand grip is coupled to said shaft, each of said holes including an open end for engaging with said bars and an enclosed end, each of said holes including a length longer than that of said bars such that an enclosed space is formed in each of said holes when said bars are engaged in said holes, said enclosed spaces of said holes forming a shock absorbing means for said hand grip, and said hand grip including two opposite parallel portions each having a longitudinal recess formed therein.

* * * * *